US005246141A

United States Patent [19]

Burrows

[11] Patent Number: 5,246,141

[45] Date of Patent: Sep. 21, 1993

[54] BOTTLED WATER STATION WITH REMOVABLE RESERVOIR

[75] Inventor: Bruce D. Burrows, Valencia, Calif.

[73] Assignee: Ebtech, Inc., Columbus, Ohio

[21] Appl. No.: 955,330

[22] Filed: Oct. 1, 1992

Related U.S. Application Data

[63] Continuation-in-part of Ser. No. 688,861, Apr. 22, 1991, Pat. No. 5,192,004.

[51] Int. Cl.[5] ..... B67D 5/62

[52] U.S. Cl. ..... 222/146.1; 222/146.6; 222/185; 62/390

[58] Field of Search ..... 222/146.1, 146.2, 146.5, 222/146.6, 185; 62/390, 395, 394

[56] References Cited

U.S. PATENT DOCUMENTS

| | | | |
|---|---|---|---|
| 2,657,554 | 11/1953 | Hull | 222/146.1 |
| 3,333,438 | 4/1967 | Benua et al. | 222/146.1 |
| 3,698,603 | 10/1972 | Radcliffe | 222/146.1 |
| 4,629,096 | 12/1986 | Schroer et al. | 222/146.6 |
| 4,779,426 | 10/1988 | Desrosiers | 62/395 |
| 4,792,059 | 12/1988 | Kerner et al. | 222/146.1 |

*Primary Examiner*—Andres Kashnikow
*Assistant Examiner*—Lesley D. Morris
*Attorney, Agent, or Firm*—Kelly Bauersfeld & Lowry

[57] ABSTRACT

An improved bottled water station includes a removable reservoir module for simple drop-in installation into a station housing and to cooperate with station components to provide a selected plurality of water supplies at different temperatures for individual dispensing. The preferred reservoir module comprises a lightweight reservoir of molded plastic or the like having an open upper end for receiving and supporting an inverted water bottle, and an internal baffle plate which divides the interior of the reservoir into upper and lower chambers. A fitting on a lower end of the reservoir permits sealed reception of a chiller probe into the lower chamber, wherein the chiller probe is provided as part of a refrigeration system on the station housing. In addition, a fitting on the lower end of the reservoir interconnects water from the upper reservoir chamber with a heated water tank on the station housing. Separate faucet valves are carried by the reservoir and are disposed in accessible positions at the front of the station housing for individual dispensing of chilled water from the lower reservoir chamber and hot water from the heated tank. If desired, another faucet valve may be provided for dispensing water substantially at room temperature from the upper reservoir chamber. An improved chiller probe and improved heated water tank are also disclosed.

29 Claims, 11 Drawing Sheets

FIG. 1
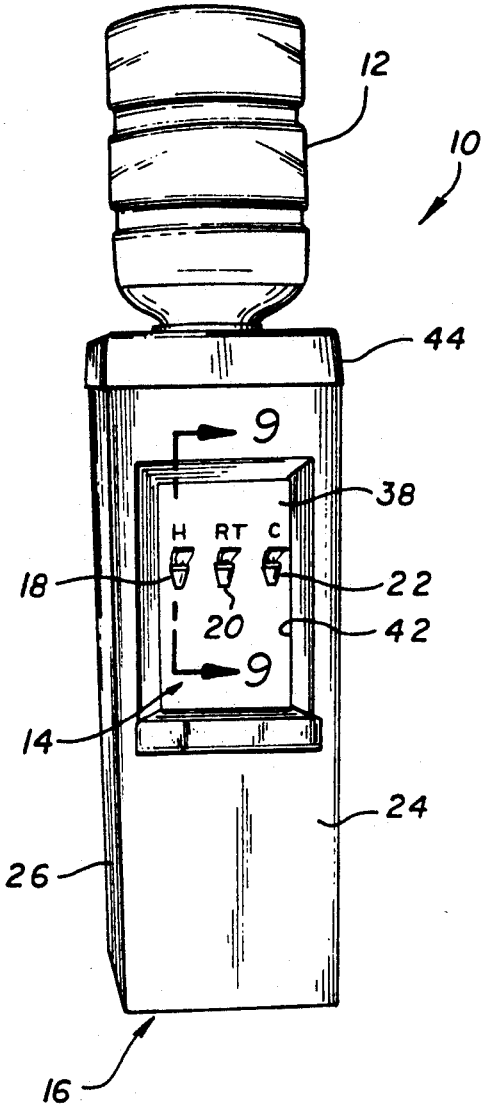
FIG. 2
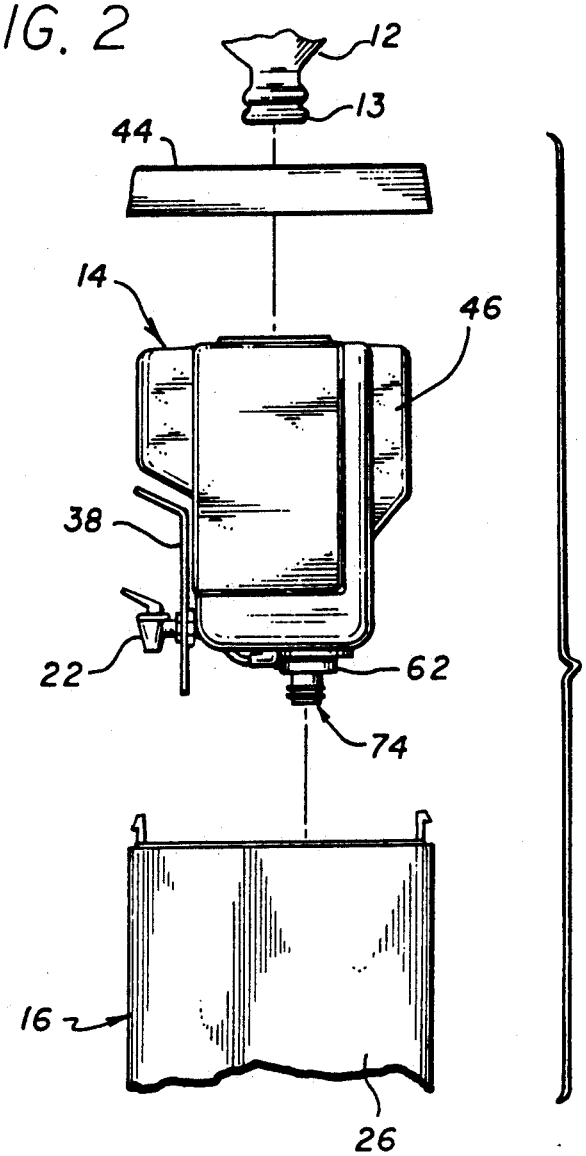
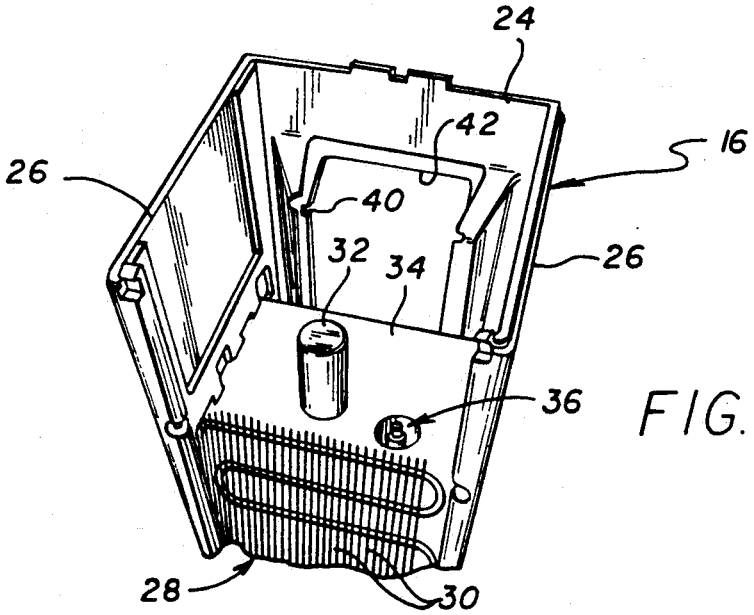
FIG. 3

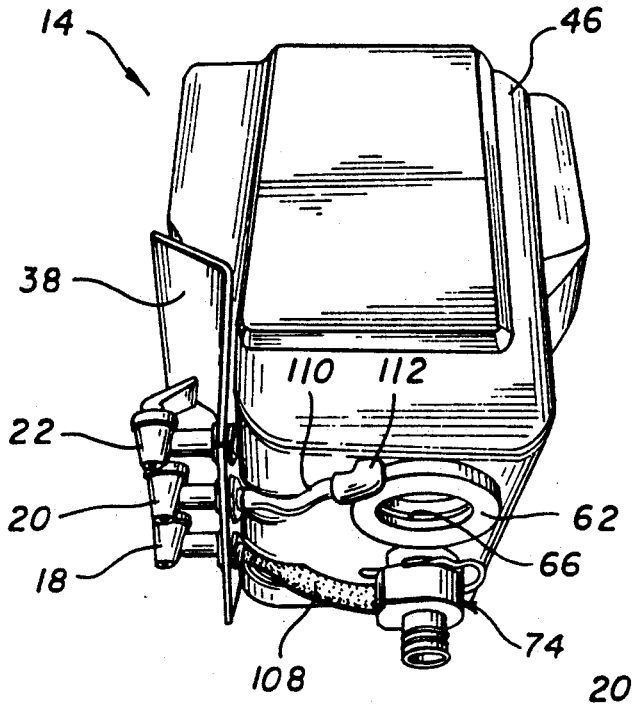
FIG. 4
FIG. 5
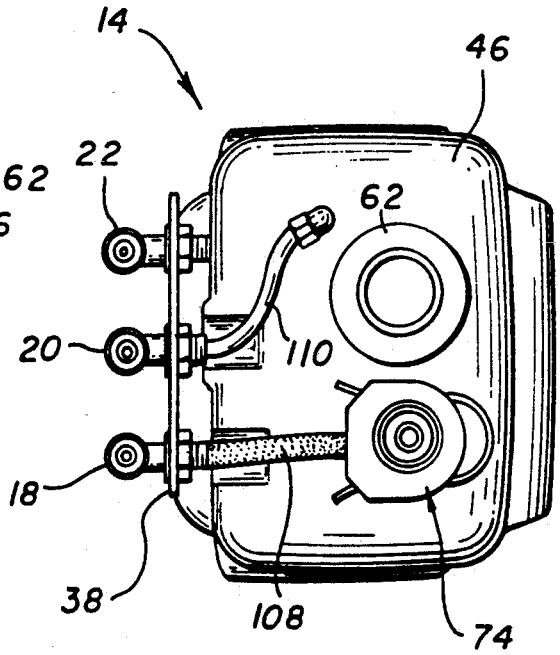
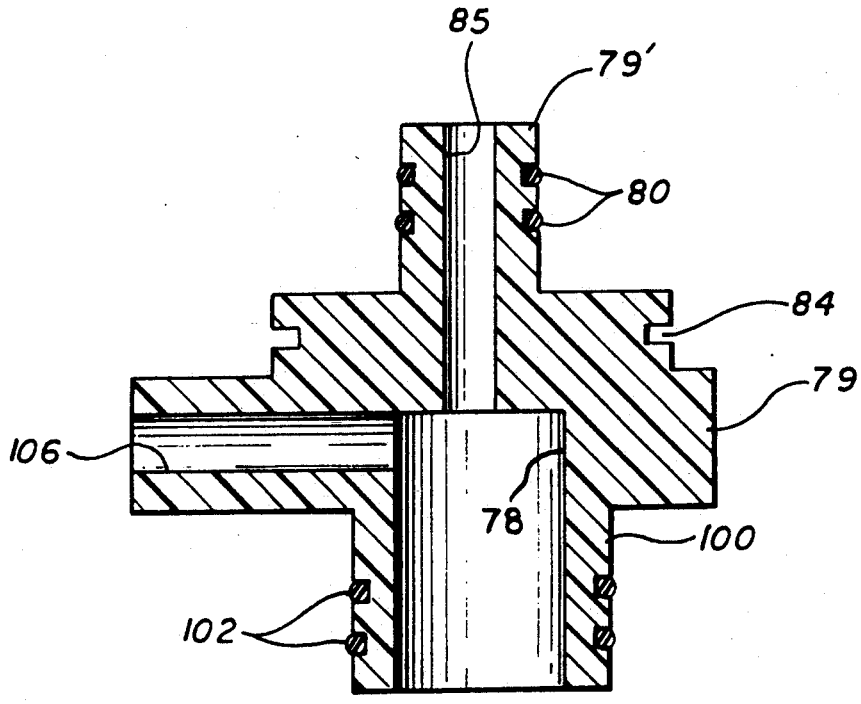
FIG. 8

BOTTLED WATER STATION WITH REMOVABLE RESERVOIR

BACKGROUND OF THE INVENTION

This is a continuation-in-part of copending U.S. Ser. No. 07/688,861, filed Apr. 22, 1991 now U.S. Pat. No. 5,192,004.

This invention relates generally to improvements in bottled water dispenser stations of the type adapted to receive and support a water bottle in an inverted position, and to selectively dispense water therefrom. More specifically, this invention relates to an improved bottled water station having a removable reservoir module designed for drop-in installation into a station housing in operative engagement with housing components to provide separately dispensable water supplies at different temperature levels.

Bottled water dispenser stations are well known in the art for containing a supply of relatively purified water in a convenient manner and location ready for substantially immediate dispensing and use. Such bottled water stations commonly include an upwardly open reservoir mounted on a station housing and adapted to receive and support an inverted water bottle of typically three to five gallon capacity. Water within the inverted bottle flows downwardly into the station reservoir for selective dispensing therefrom through a faucet valve on the front of the station housing. Such bottled water stations are widely used to provide a clean and safe source of water for drinking and cooking, especially in areas wherein the local water supply is suspected to contained undesired levels of contaminants.

In bottled water stations of the above-described type, the water bottles are normally provided in a clean and preferably sterile condition with an appropriate sealed cap to prevent contamination of the water contained therein. When an inverted bottle on a station housing reaches an empty condition, the empty bottle can be lifted quickly and easily from the station housing and replaced by a filled bottle having the sealing cap removed therefrom. The empty bottle can then be returned to the bottled water vendor for cleaning and refilling.

Although bottled water stations of this type utilize a sequence of water bottles which have been individually sanitized, the water reservoir within the station housing is not subjected to periodic cleaning or replacement. In this regard, the housing reservoir commonly comprises a metal or ceramic tank mounted within the station housing in association with a refrigeration system for maintaining water within the reservoir in a chilled condition. In other station housing designs, an auxiliary reservoir is provided in association with suitable heating elements for providing a heated water supply. Unfortunately, the integration of the station housing reservoir with associated chilling and/or heating systems has generally precluded easy reservoir removal for cleaning purposes. Instead, the housing reservoir has typically been used for prolonged time periods without cleaning, thus creating the potential for undesirable growth of harmful bacteria and other organisms. Reservoir cleaning has generally been possible by taking the station out of service and returning the station to a centralized facility for cleaning purposes.

In one proposed construction for a bottled water station, a removable reservoir container has been suggested for easy drop-in placement and lift-out removal with respect to a supporting chiller plate within a station housing. See U.S. Pat. No. 4,629,096. While this configuration beneficially permits reservoir removal for cleaning purposes, no provision has been made to supply a desirable heated water supply in addition to a chilled water supply. Moreover, the supported placement of the removable reservoir container onto a refrigerated chiller plate inherently and undesirably provides a large surface area and associated space conducive to frost and/or condensation build-up between the chiller plate and the reservoir container.

The present invention overcomes the problems and disadvantages of the prior art by providing an improved bottled water station having a modular water reservoir adapted for simple drop-in installation into the station housing, and for correspondingly simple slide-out removal therefrom. Accordingly, the reservoir module may be removed from the station housing quickly and easily for cleaning purposes, with a clean replacement reservoir module being easily installed into the station housing to permit the bottled water station to remain in service. The improved bottled water station is further adapted to minimize or eliminate frost and condensation associated with refrigerated chiller equipment, and is compatible for supply of both chilled and heated water supplies.

SUMMARY OF THE INVENTION

In accordance with the invention, an improved bottled water station includes a removable reservoir module for drop-in, slide-fit installation into a station housing, and for receiving and supporting a water supply bottle in an inverted position. The reservoir module includes a lightweight reservoir having fittings thereon for slide-fit connection in a sealed manner with station components, such as a chiller probe for chilling water within the reservoir, and a heated water tank for receiving and heating a portion of the water from the reservoir. Faucet valves mounted on one side of the reservoir module are oriented in an exposed, accessible position at the front of the station housing when the reservoir module is mounted in place. The reservoir module including the lightweight reservoir and the associated faucet valves is quickly and easily removed as a unit from the station housing for cleaning purposes.

In the preferred form of the invention, the lightweight reservoir is constructed from molded plastic or the like to include an open upper end for receiving and supporting an inverted water bottle, thereby permitting water to drain by gravity from the bottle into the reservoir. A baffle plate within the reservoir divides the reservoir into upper and lower chambers, with at least one flow port in the baffle plate permitting restricted water flow therebetween. A cylindrical fitting is mounted at the lower end of the reservoir for sealed, slide-fit reception of an upstanding chiller probe mounted on the station housing as part of a refrigeration system. The reservoir module is mounted into the station housing in a drop-in manner for slidably interengaging the chiller probe fitting with the chiller probe, such that operation of the refrigeration system functions to cool or chill water within the lower reservoir chamber by direct contact of the chiller probe with the water. A faceplate at one side of the reservoir is exposed to the front of the station housing and includes a manually operated faucet valve for dispensing chilled water from the lower reservoir chamber.

Water within the upper reservoir chamber is connected via a bypass tube with a fitting on the bottom of the reservoir adapted for slide-fit connection with inlet and outlet members associated with a small heated water tank mounted within the station housing. When the reservoir module is mounted in place, water may flow from the upper chamber through the bypass tube into the hot water tank for heating. The thus-heated water may pass through the outlet member and the associated fitting for routing further to a manually operated faucet valve on the faceplate.

In accordance with still further aspects of the invention, a third faucet valve on the faceplate may be provided for dispensing water directly from the upper reservoir chamber, without intervening heating or cooling. Accordingly, this third faucet may be used for dispensing water essentially at room temperature.

Moreover, the chiller probe and/or the heated water tank can be economically constructed from predominantly molded plastic components. In particular, the chiller probe can be formed from molded plastic, with a refrigeration coil or the like mounted therein. Efficient heat transfer for cooling purposes is achieved by filling the residual volume of the probe with a viscous gel material or the like chosen to provide intimate surface contact for heat transfer purposes between the refrigeration coil and the probe. A modified heated water tank may also be constructed from molded plastic components, with a heating unit mounted on the tank to define one wall thereof. The heating unit is preferably installed as a bottom wall for the heated water tank in a position for convenient removal in the event that replacement is required.

Other features and advantages of the present invention will become more apparent from the following detailed description, taken in conjunction with the accompanying drawing which illustrate, by way of example, the principles of the invention.

BRIEF DESCRIPTION OF THE DRAWINGS

The accompanying drawings illustrate the invention. In such drawings:

FIG. 1 is a front perspective view illustrating a bottled water dispenser station adapted for use with the removable reservoir module embodying the novel features of the invention;

FIG. 2 is a fragmented and exploded side elevational view depicting drop-in installation of the reservoir module into a station housing;

FIG. 3 is an enlarged rear perspective view of the station housing, with the removable reservoir module separated therefrom;

FIG. 4 is an enlarged bottom perspective view depicting the removable reservoir module of the present invention;

FIG. 5 is a bottom plan view of the reservoir module;

FIG. 8 is an enlarged vertical sectional view taken generally on the line 8—8 of FIG. 7;

DETAILED DESCRIPTION OF THE PREFERRED EMBODIMENTS

Figure 6:
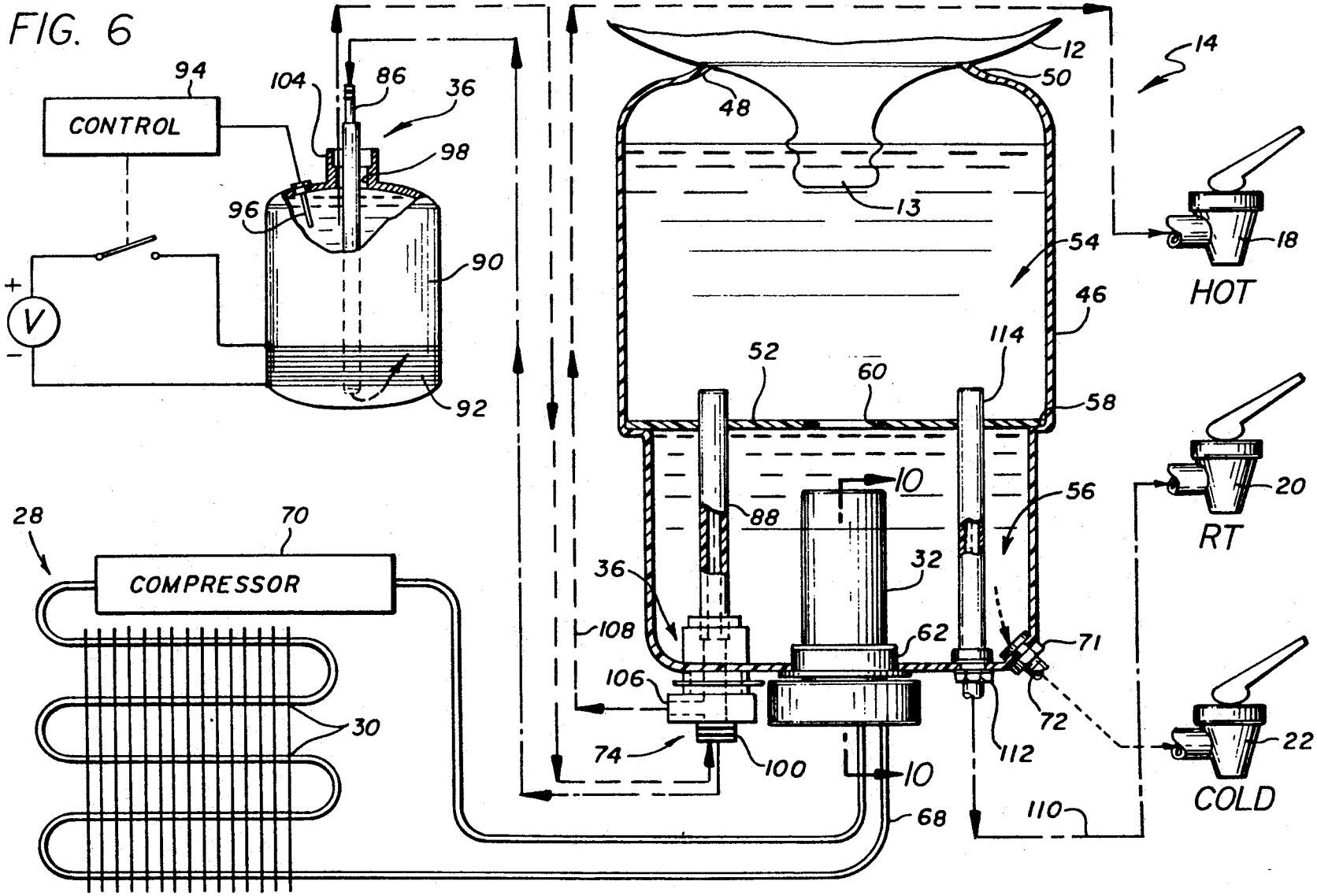
FIG. 6 is a diagrammatic representation of the removable reservoir module in association with operating components of the station housing.
Figure 7:
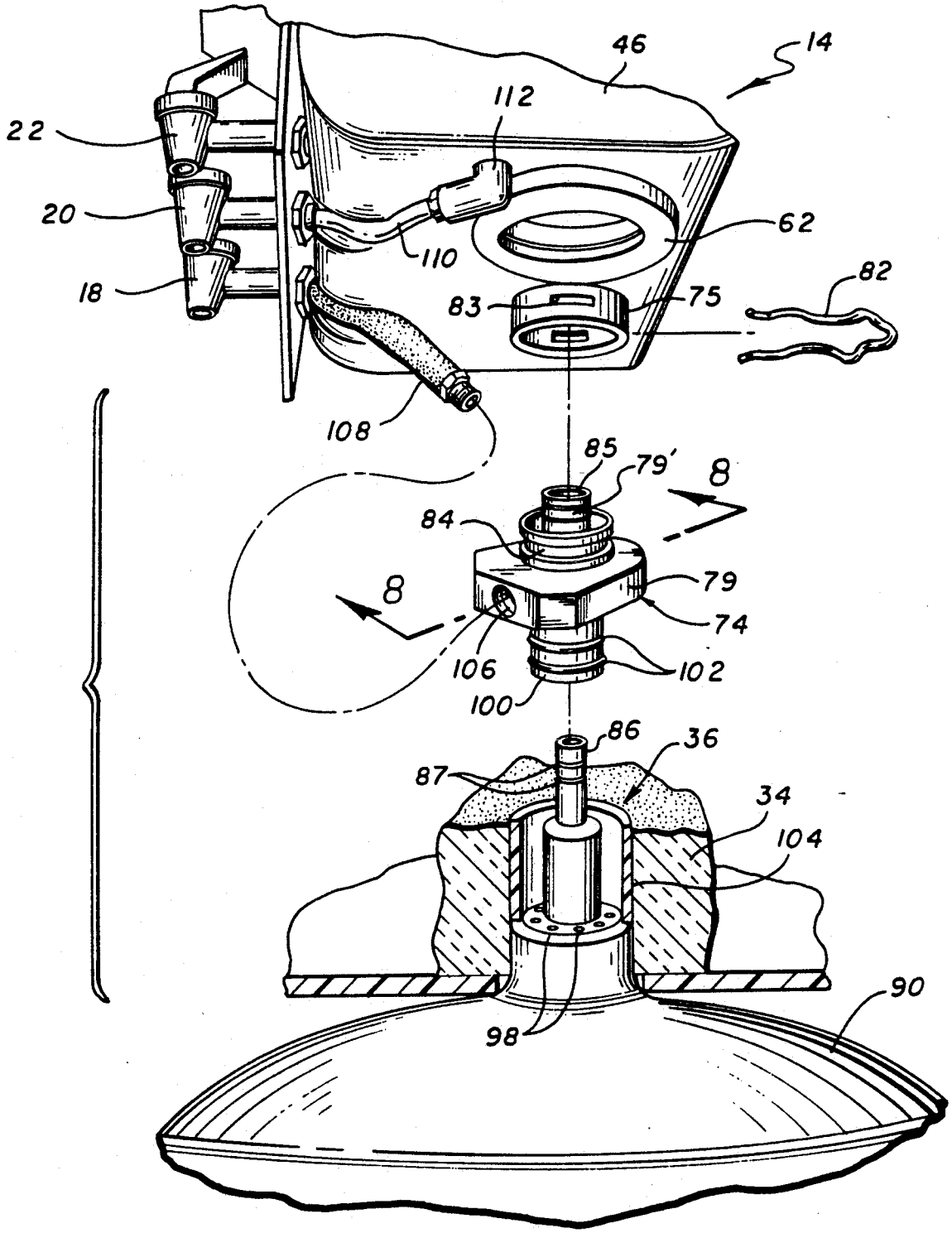
FIG. 7 is an enlarged and fragmented exploded perspective view illustrating slide-fit assembly of the reservoir module with an underlying hot water tank mounted within the station housing.

As shown in the exemplary drawings, a bottled water dispenser station referred to generally in FIG. 1 by the reference numeral 10 is provided for receiving and supporting a water bottle 12 containing a supply of relatively purified water for drinking and cooking uses, etc. The bottled water station 10 includes a removable reservoir module 14 (FIGS. 1 and 2) for receiving and supporting the water bottle 12, wherein the reservoir module 14 can be removed quickly and easily as required for purposes of cleaning or replacement.

The illustrative bottled water station 10 has a generally conventional overall size and shape to include an upstanding station housing 16. The station housing 16, in combination with the reservoir module 14 to be described in more detail, supports the water bottle 12 in an inverted orientation such that water contained therein will flow downwardly by gravity into the reservoir module 14. In accordance with the present invention, the reservoir module 14 interfaces with station components to provide multiple water supplies at different selected temperature levels. These temperature controlled water supplies are adapted for separate dispensing via manually operated faucet valves accessibly exposed on the front of the station housing 16. The preferred embodiment shown in the accompanying drawings includes three faucet valves 18, 20, and 22 for independent dispensing of hot water, room temperature water, and chilled water, respectively. Importantly, the reservoir module 14 inclusive of the associated faucet valves is designed for simple drop-in and slide-fit mounting into the station housing 16, and for subsequent simple slide-out removal, when desired.

With reference to FIGS. 1–3, the station housing 16 has an upstanding, generally rectangular configuration to include a front wall 24 joined to housing side walls 26, and a housing back which has a typically open construction (FIG. 3). A refrigeration system 28 is normally mounted within a lower portion of the housing interior and includes finned heat transfer tubing 30 mounted across the open back of the housing 16 (FIG. 3). In accordance with the invention, a cylindrical chiller probe 32 constituting a portion of the refrigeration system 28 projects upwardly from a support platform 34 extending horizontally within the housing 16 at a position spaced below the upper end of the housing. Hot water flow tubes referred to generally in FIG. 3 by the reference numeral 36 are also exposed through the support platform 34.

The front and side walls of the station housing 16 cooperate with the support platform 34 to define an upwardly open cavity at the upper end of the station housing. In general terms, the removable reservoir module 14 is designed for drop-in mounting into this cavity, and for slide-fit engagement with the chiller probe 32 and the hot water flow tubes 36 as an incident to drop-in installation. A relatively thin faceplate 38 is included at a front side of the reservoir module 14 for sliding fit within a track 40 formed by the front wall 24 along opposite sides of a front wall opening 42. The faceplate 38 is thus accessibly exposed through the front wall opening 42 when the module 14 is mounted in place, with said faceplate 38 providing a mounting support surface for the faucet valves 18, 20, and 22. A housing cap 44 may be provided for snap-fit mounting onto the underlying housing walls 24 and 26 in a position covering the reservoir module 14.

The housing cap 44 has a large central aperture (not shown) formed therein to accommodate downward passage therethrough of the neck 13 of an inverted water supply bottle 12 (FIGS. 1 and 2). In this regard, the reservoir module 14 comprises a lightweight reservoir 46 constructed from molded plastic or the like to include a relatively large opening 48 in the upper end thereof, as viewed in FIG. 6. A shaped rim 50 is formed about the opening 48 to provide structural support sufficient to receive and support the inverted bottle 12. Accordingly, water within the bottle 12 may flow by gravity in a downward direction into the reservoir 46 to substantially fill the reservoir 46. In this regard, as known in the art, the water within the bottle 12 will flow into and fill the reservoir 46 to a level slightly above the open bottle neck 13, with any additional water being retained and stored within the bottle for flow into the reservoir in increments as water is dispensed from the reservoir via the faucet valves.

In accordance with one aspect of the invention, the interior of the reservoir 46 is subdivided by a baffle plate 52 (FIG. 6) into an upper chamber 54 and a lower chamber 56. The baffle plate conveniently comprises a sheet of relatively lightweight plastic material which can be inserted through the reservoir opening 48 and seated upon an internal shoulder 58 defined conveniently at a narrowed transition region between a wider upper and narrower lower portion of the reservoir 46. A central flow port 60 in the baffle plate 52 permits at least some water flow communication between the upper and lower chambers 54 and 56.

A cylindrical probe fitting 62 is mounted at a lower end of the reservoir 46 for slide-fit sealed connection with the chiller probe 32 when the module 14 is installed into the station housing. More specifically, the probe fitting 62 (FIGS. 4–8 and 10) has a generally collar like shape mounted within a lower opening 64 which communicates with the lower reservoir chamber 56. The size and shape of the cylindrical probe fitting 62 permits slide-fit reception over the cylindrical chiller probe 32, with an internal seal ring 66 on the probe fitting 62 insuring leak-free slide-fit engagement therebetween. Accordingly, simple drop-in installation of the reservoir module 14 into the station housing 16 engages the probe fitting 62 with the chiller probe 32, such that the chiller probe 32 extends upwardly into the lower chamber 56 of the reservoir 46.

During normal operation of the bottled water station 10, a cooling coil 68 (FIGS. 6 and 10) circulates a fluid refrigerant through the chiller probe 32 for substantially chilling or cooling water contained within the lower reservoir chamber 56. These cooling coils 68 are appropriately integrated into the refrigeration system 28 which includes the finned heat exchanger tubing 30 and associated motor-driven compressor 70 (FIG. 6). Importantly, the baffle plate permits downward water flow through the flow port 60 to fill the lower chamber 56, while simultaneously providing a partial thermal barrier separating the chilled water in the lower chamber 56 from water contained within the upper reservoir chamber 54. The cold water faucet valve 22 comprises a conventional manually operated spigot with an appropriate valve handle for dispensing chilled water from the lower reservoir chamber 56. In this regard, the chilled water faucet valve 22 is interconnected with the lower reservoir chamber 56 by means of a fitting 71 mounted through the reservoir 46 at or near the bottom thereof, and a short flow conduit 72.

Figure 9:
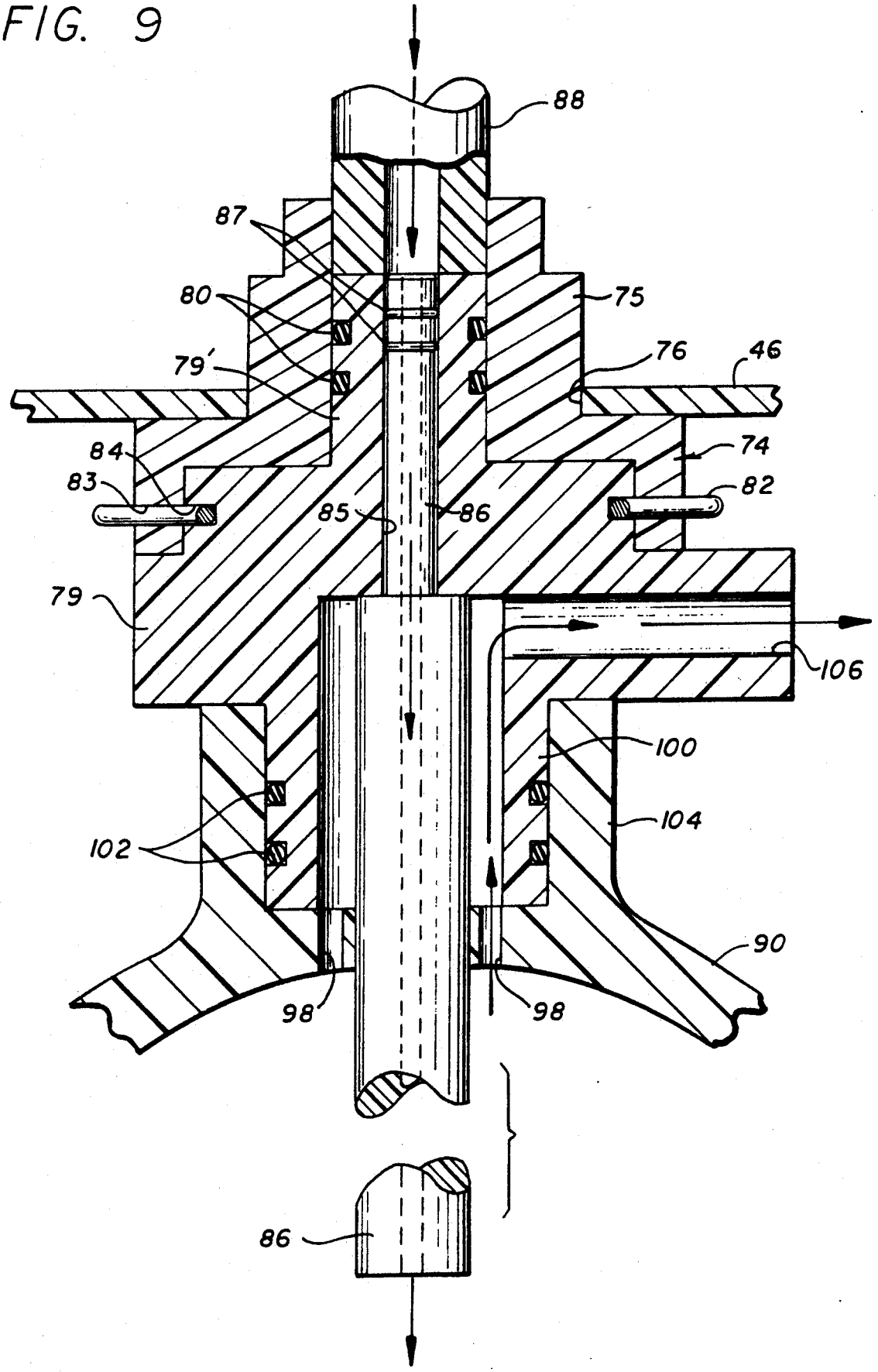
FIG. 9 is an enlarged and fragmented vertical sectional view taken generally on the line 9—9 of FIG. 1.
Figure 10:
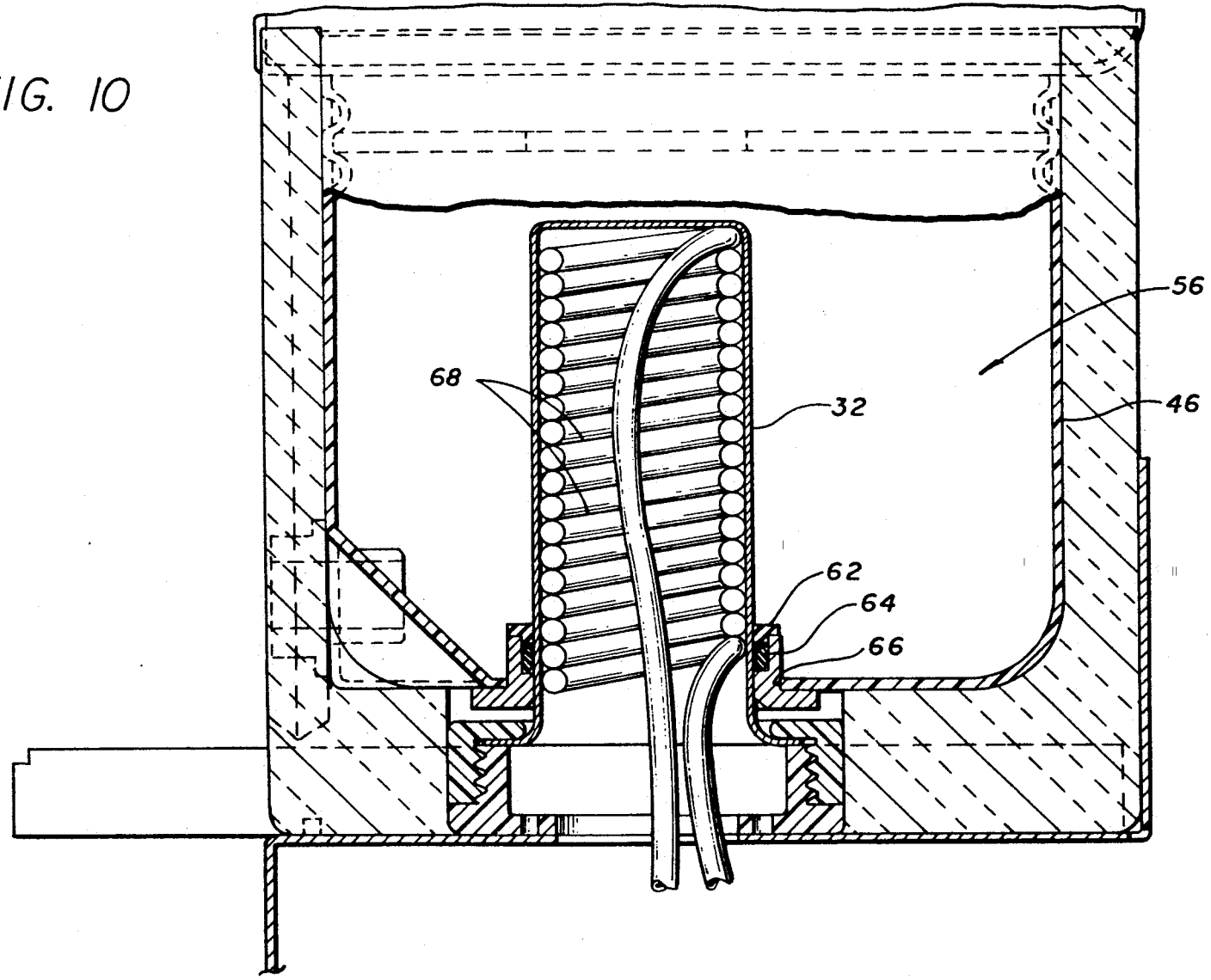
FIG. 10 is an enlarged and fragmented vertical sectional view taken generally on the line 10—10 of FIG. 6.

The reservoir module 14 is also adapted for simple slide-fit connection with the hot water flow tubes 36 (FIG. 3) in response to drop-in reservoir installation into the station housing. To achieve this connection, a hot water fitting 74 is mounted at the bottom of the reservoir 46. As shown best in FIGS. 7–9, the hot water fitting 74 includes a cylindrical upper fitting member 75 seated within an opening 76 formed in the bottom of the reservoir 46 and defining an internal stepped bore passage 78. A cylindrical lower fitting member 79 includes an upper stem 79' with appropriate seal rings 80 for sealed slide-fit reception in an upward direction into the upper member 75. A spring clip 82 is provided as a convenient mechanism for releasibly interconnecting the upper and lower fitting members 75 and 79. As shown, the spring clip 82 is positioned about an expanded lower end of the fitting member 75 and passes through open slots 83 in the fitting member 75 to seat within a recess 84 in the other fitting member 79, thereby locking the components together.

The lower fitting member 79 has a relatively small upper bore 85 formed therein for slide-fit reception of a hot water inlet tube 86 having appropriate seal rings 87 thereon. This hot water inlet tube 86 constitutes one of the hot water flow tubes 36 and projects upwardly from the housing support platform 34 (FIG. 3) for slide-fit engagement into the hot water fitting 74 when the module 14 is mounted in place. This inlet tube 86 is thus connected in line with an upstanding bypass tube 88 (FIGS. 6 and 8) which communicates through the baffle plate 52 with water contained in the upper reservoir chamber 54. This substantially unchilled water from the upper chamber 54 is guided through the hot water inlet tube 86 substantially to the lower end of a hot water tank 90 (FIG. 6) mounted within the station housing 16 at a suitable location below the support platform 34.

As shown in FIG. 6, the hot water tank 90 which may be formed from stainless steel or the like has a resistance element heating band 92 mounted thereon in association with a control circuit 94 for elevating the temperature of water contained within the tank 90. A suitable thermostatic control 96 is provided in conjunction with the control circuit for regulating heater band operation to prevent excessive power consumption and/or overheating of the water.

Heated water within the hot water tank 90 may be dispensed by upward passage through a plurality of discharge ports 98 formed in a circumferential pattern about the hot water inlet tube 86. These discharge ports 98 lead upwardly into the interior of a lower stem 100 forming a portion of the lower member fitting 79 and having seal rings 102 for seated slide-fit reception into a cylindrical sleeve 104 at the upper end of the hot water tank 90. The hot water flows further through this lower stem 100 to a side port 106 adapted for connection through a conduit 108 to the hot water faucet valve 18 for dispensing.

In accordance with a further aspect of the invention, the room temperature faucet valve 20 may be provided to obtain still another water supply at a different temperature level. More particularly, as shown in FIG. 6, the room temperature faucet valve 20 is connected through a short conduit 110 to receive water from the upper reservoir chamber 54. In the preferred form, this conduit connection is obtained by a fitting 112 connected through the bottom of the reservoir 46, wherein this fitting is connected to a standpipe 114. The standpipe 114 extends upwardly through the lower chamber 56 and a short distance past the baffle plate 52 for receiving substantially unchilled and unheated water from the upper chamber 54.

The improved bottled water station 10 can thus be used in a normal manner to receive and support an inverted water bottle 12, and to dispense the bottled water as multiple water supplies at different selected temperatures. The preferred form of the invention includes at least the chilled water supply and preferably additional water supplies such as heated and/or room temperature supplies. The reservoir is adapted for internal positioning of the chiller probe 32, thereby substantially eliminating frost or condensation build-up which could otherwise occur between the reservoir and external chiller means. The reservoir module 14 including the lightweight water reservoir 46 and the group of faucet valves is designed for simple and quick mounting into the station housing 16, with automatic operative connection with the refrigeration and heating systems upon module installation. Similarly, the module 14 can be removed quickly and easily for cleaning, and if desired replaced with a substitute module, all without removing the bottled water station from service.

Figure 11:
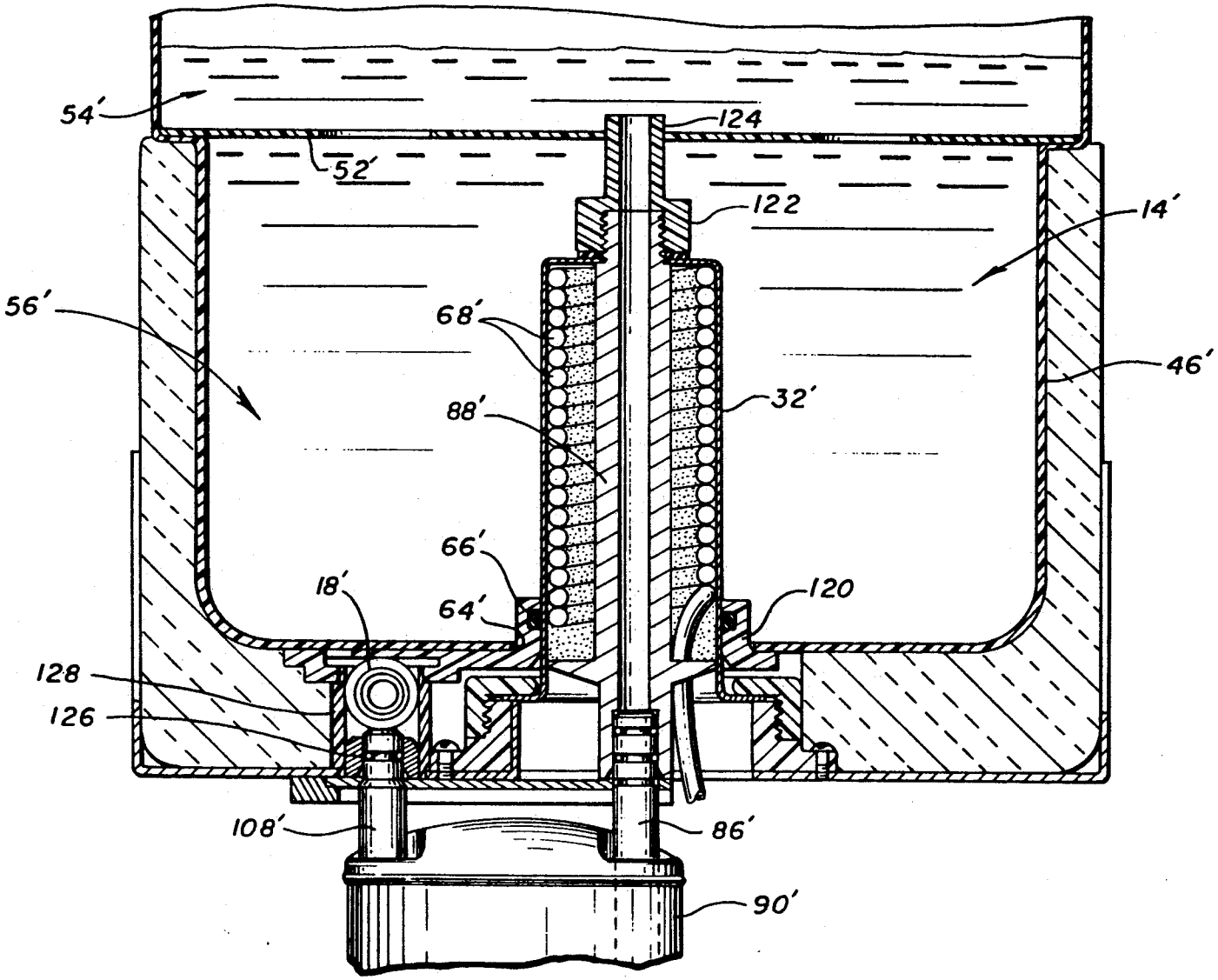
FIG. 11 is an enlarged and fragmented vertical sectional view similar to FIG. 10, but depicting an alternative preferred form of the invention.

FIG. 11 depicts one alternative preferred form of the invention, wherein a modified reservoir module 14' includes a lightweight plastic reservoir 46' having a single fitting 120 at the bottom thereof for slide-fit registration with refrigeration and heating system components of a bottled water station housing. More particularly, an opening 64' in the bottom of the reservoir 46' has the cylindrical collar fitting 120 mounted therein with an internal seal ring 66' for slide-fit sealed engagement with a chiller probe 32' upstanding from a support platform within the station housing. A cooling coil 68' is again wrapped within the chiller probe 32' and functions as part of a refrigeration system to chill water within a lower reservoir chamber 56' beneath a baffle plate 52'. However, in the embodiment of FIG. 11, a bypass tube 88' is mounted concentrically within the chiller probe 32' and has an upper end projecting above the chiller probe for connection via a suitable fitting 122 through a port 124 in the baffle plate 52' to the upper reservoir chamber 54'. This fitting 122 is positioned to slide through the baffle plate port 124 as an incident to reservoir module mounting into the station housing.

A lower end of the bypass tube 88' terminates in a nipple engaged with a hot water inlet tube 86' through which water from the upper reservoir chamber 54' can flow into an underlying hot water tank 90'. This hot water tank 90' heats the water therein in the manner previously described with respect to FIG. 6, and this hot water can be dispensed from the tank 90' through an outlet tube 108'. As shown in FIG. 11, this outlet tube 108' includes a seal ring 126 for slide-fit registration with a fitting 128 on the bottom of the reservoir 46' when the reservoir module is mounted in place. This fitting 128 is connected in turn to an associated hot water faucet 18' on the front of the reservoir module for hot water dispensing. Accordingly, in the embodiment of FIG. 11, chilled and heated water supplies are available with a single opening and related sealed fitting 120 at the bottom of the reservoir.

Figure 12:
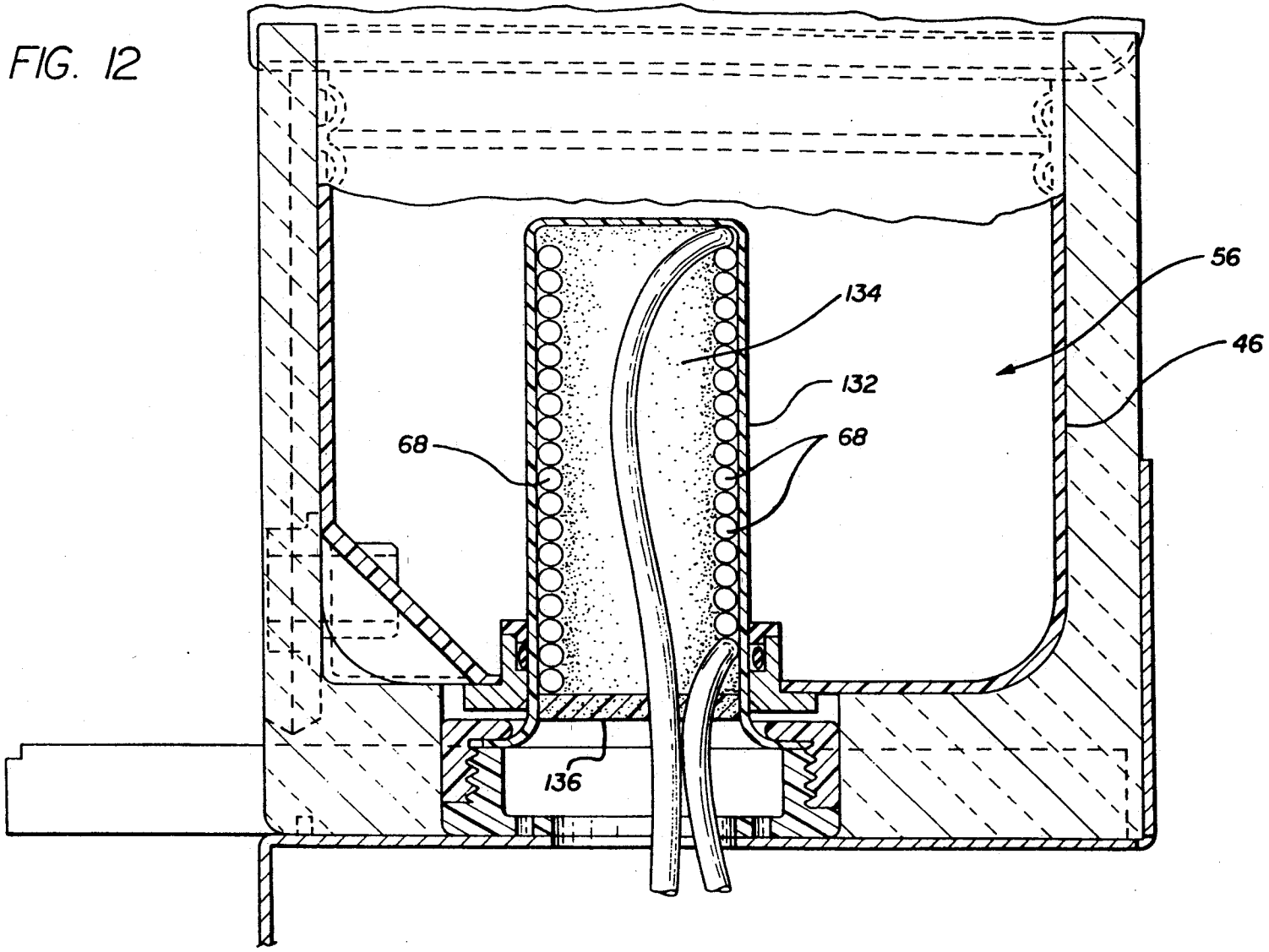
FIG. 12 is an enlarged and fragmented vertical sectional view similar to FIG. 10, and depicting one alternative preferred form of the invention.

FIG. 12 shows another alternative preferred form of the invention, wherein a modified chiller probe 132 is constructed from a lightweight molded plastic material, such as a high density polyethylene or the like. In this embodiment, the probe 132 is constructed generally to conform with the probe 32 shown and described in FIG. 10, but wherein a plastic probe material is used instead of a metal such as stainless steel. The cooling coils 68 are mounted within the interior of the hollow, downwardly open probe 132, in a spiral array to provide a temperature controller thermal element separated from the water by the thickness of the plastic probe. Improved thermal exchange between the coils 68 and the probe 132 is obtained by filling the otherwise residual volume of the probe interior with a viscous gel material 134 chosen for heat transfer properties. The gel material 134 provides a broad surface area of uninterrupted conductive thermal exchange between the coils 68 and probe 132, for high efficiency chilling of the reservoir water notwithstanding the use of the plastic material to form the probe. While a variety of gel materials may be used, one preferred material comprises a polymeric heat transfer compound marketed by the Presstite Division of Inmont Corporation, St. Louis, Mo., under the name Presstite Thermal Mastic. A retainer disk 136 of foam material or the like can be press-fit into the open lower end of the probe 132 to insure retention of the gel material 134 therein.

Figure 13:
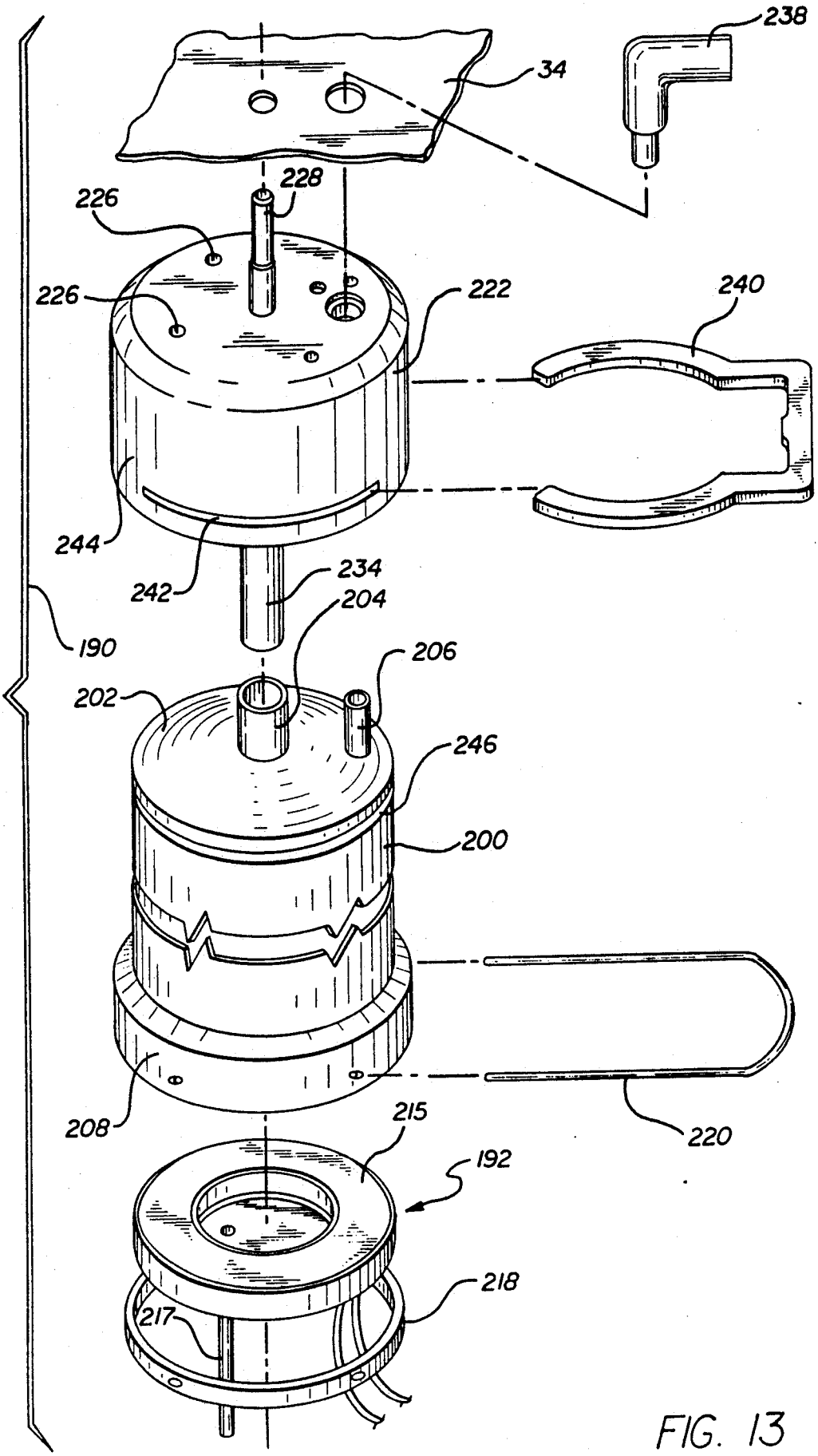
FIG. 13 is an exploded perspective view illustrating an alternative embodiment of the heated water tank for use in the invention.
Figure 14:
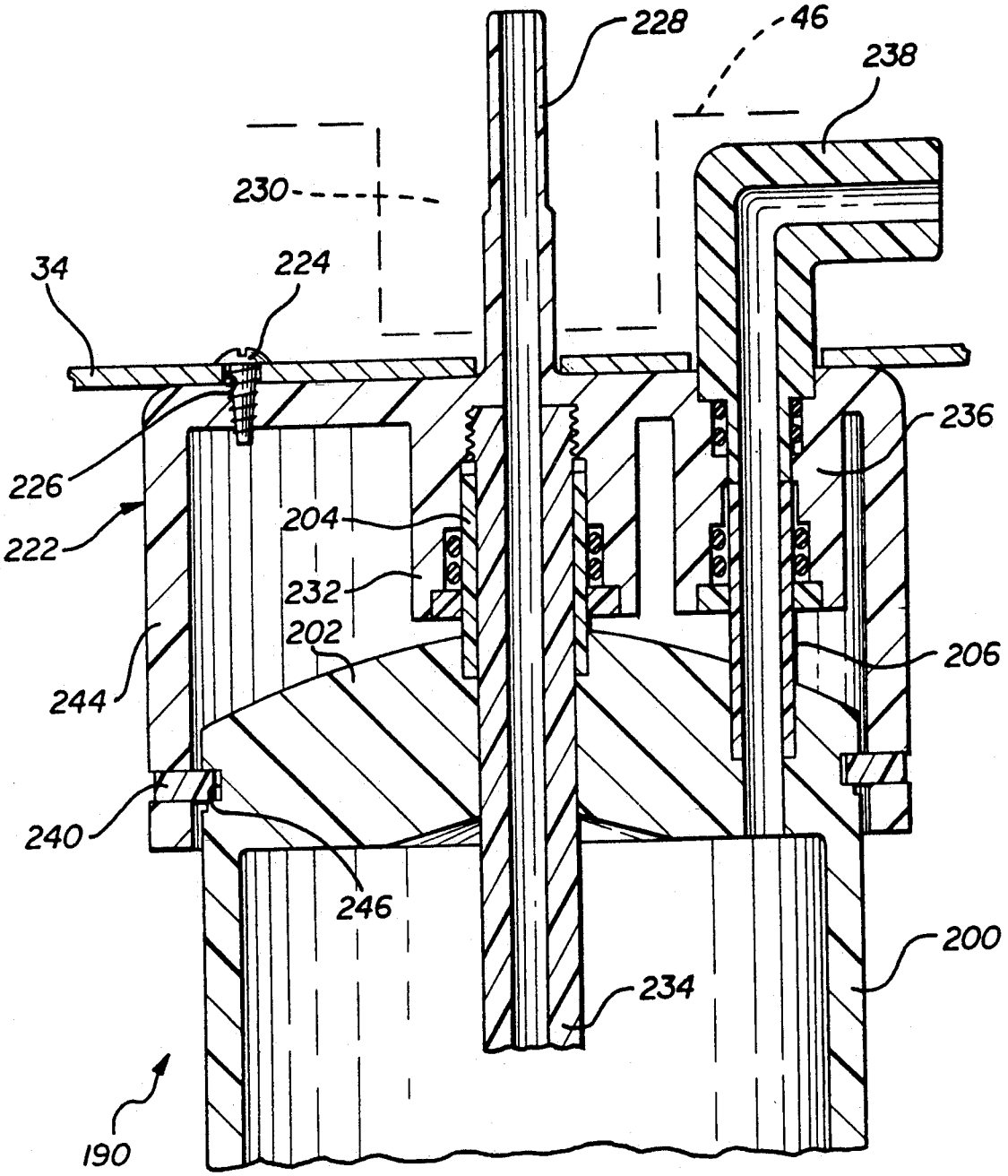
FIG. 14 is an enlarged and fragmented sectional view showing assembly of an upper portion of the heated water tank of FIG. 13.
Figure 15:
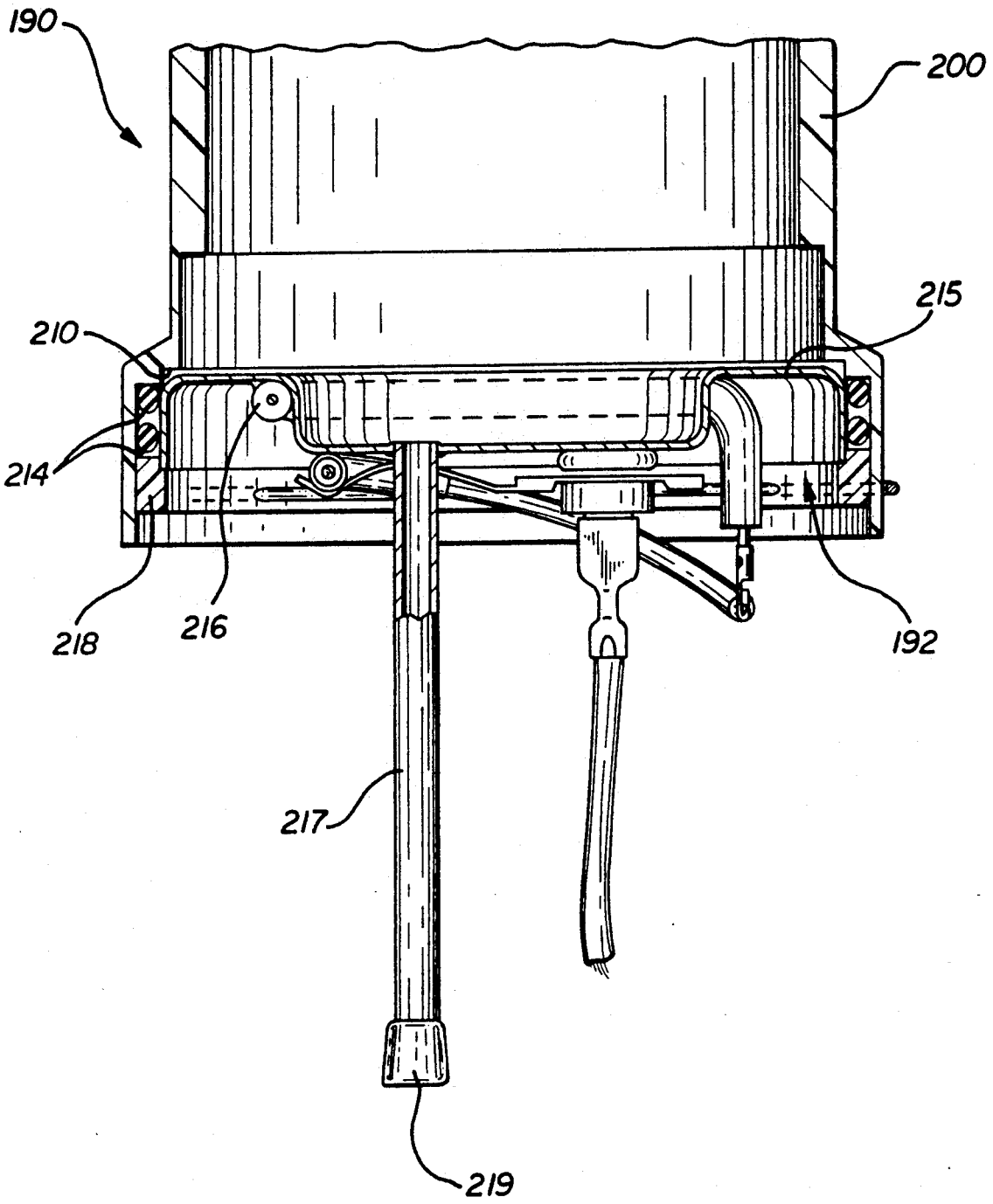
FIG. 15 is an enlarged and fragmented sectional view showing assembly of a lower portion of the heated water tank of FIG. 13.

An alternative embodiment of a hot water tank for use with the bottled water station is shown in FIGS. 13–15. In general, a modified hot water tank 190 is provided with a predominant construction from economic plastic molded material. The tank 190 is designed for convenient and simple installation into the bottled water station, and includes a removably mounted heating unit 192 for efficient heating of water within the tank.

More specifically, as shown in FIG. 13, the modified hot water tank 190 comprises a generally cylindrical tank shell 200 formed from a molded plastic material such as polyethylene plastic or other suitable material selected to withstand normal hot water operating temperatures. The tank shell includes an upper end wall 202 interrupted by a centrally positioned water inflow tube 204 and an offset water outflow tube 206. The lower end of the tank shell 200 is open and includes a diametrically expanded segment 208 defining a downwardly presented internal shoulder 210 (FIG. 15). A disk-shaped heating unit 192 is pressed into the segment 208, preferably in association with seal rings 214. The heating unit comprises a metal plate 215 having a resistance heating element 216 secured as by soldering to the underside thereof. A mounting ring 218 is positioned within the tank shell below the heating unit, and a spring clip 220 fits through aligned ports in the mounting ring 218 and the tank segment 208 to lock the components in place. A central region of the metal plate 215 is recessed at a location circumscribed by the heating element 216 to provide a sediment accumulation site which does not interfere with heating efficiency. A drain tube 217 normally closed by a cap 219 conveniently permits drainage of water from the tank, when desired.

As shown in FIGS. 13 and 14, the tank 190 is adapted to mount quickly and easily at the underside of the reservoir support platform 34, by means of an inverted, cup-shaped mounting cap 222. The mounting cap 222, which may also be formed from molded plastic, is mounted securely to the underside of the platform 34 by screws 224 passed through cap ports 226. A tubular nipple 228 projects upwardly through the platform 34 for slide-fit reception into a mating fitting 230 at the bottom of a water reservoir 46, when that reservoir is installed into the station 10. The inflow tube 204 on the tank shell 200 is adapted for slide-fit reception into a mating fitting 232 on the underside of the cap 222, for in-line flow of water downwardly through the nipple 228 and inflow tube 204 into the tank. An elongated delivery tube 234 is conveniently carried by the cap 222 to project downwardly into the tank 190, for delivery reservoir water to a position in close relation to the heating unit 192.

The outflow tube 206 of the tank 190 is also adapted for slide-fit engagement with a mating fitting 236 on the underside of the mounting cap 222 (FIG. 13). This outflow tube 206 provides a hot water discharge path to an elbow fitting 238 which extends upwardly through the platform and is connected ultimately to the hot water faucet. Importantly, when the tank 190 is positioned with the inflow and outflow tubes 204 and 206 seated respectively with the fittings 232 and 236, a spring clip 240 can be positioned to extend through side slots 242 in a cap skirt 244 for locked engagement with a circumferential groove 246 in the tank shell.

In use, the hot water tank 190 is installed quickly and easily into the mounting cap 222 by slide-fit engagement therewith and deployment of the spring clip 240. Similarly, the heating unit 192 is installed quickly and easily into the tank shell 200 by slide-fit placement and spring clip mounting of the lower mounting ring 218. Appropriate seal rings are provided to seal each assembled component. Replacement of the tank 190, or independent replacement of the heating unit 192, may be accomplished quickly and easily by mere slide-out component removal and slide-in replacement with a new component.

A variety of further modifications and improvements to the bottled water station and reservoir module will be apparent to those skilled in the art. Accordingly, no limitation on the invention is intended by way of the foregoing description and accompanying drawings, except as set forth in the appended claims.

What is claimed is:

1. A water station, comprising:

a reservoir module including a hollow reservoir for receiving and storing a supply of water and faucet means for dispensing water from said reservoir;

a station housing having support means for receiving and supporting said reservoir module, said station housing including a temperature control probe; and means for sealed reception of said probe through an opening formed in said reservoir module to contact water within said reservoir, when said reservoir module is supported by said station housing support means;

said station housing further including means for controlling the temperature of said probe to correspondingly control the temperature of the water within said reservoir, said probe having a hollow interior with said temperature controlling means received therein, and further including a heat transfer medium substantially filling the hollow interior of said probe for coupling said temperature controlling means in intimate heat transfer relation with said probe.

2. The water station of claim 1 wherein said temperature control probe comprises a chiller probe, and further wherein said temperature controlling means comprises a refrigeration system having cooling means within said chiller probe.

3. The water station of claim 1 wherein said heat transfer medium comprises a viscous gel.

4. The water station of claim 1 wherein said heat transfer medium comprises a thermal mastic material.

5. The water station of claim 1 further including means for retaining said heat transfer medium within said probe.

6. The water station of claim 1 wherein said probe is formed from a plastic material.

7. The water station of claim 6 wherein said heat transfer medium comprises a thermal mastic material.

8. The water station of claim 1 wherein said sealed reception means includes fitting means for slide-fit reception of said probe.

9. The water station of claim 8 wherein said fitting means comprises a collar fitting mounted within the reservoir module opening and carrying at least one seal for sealed and slide-fit reception of said probe.

10. The water station of claim 1 wherein said station housing defines an upwardly open cavity for receiving said reservoir module, said station housing further including a generally horizontal support platform for supporting said reservoir module when said module is received into said cavity, said probe upstanding from said support platform.

11. A water station, comprising:

a reservoir module including a hollow reservoir for receiving and storing a supply of water, and faucet means for dispensing water from said reservoir;

a station housing having support means for receiving and supporting said reservoir module; and temperature control means to control the temperature of water within said reservoir, said temperature control means comprising a temperature controlled thermal element, a heat exchange surface in heat transfer relation with water within said reservoir, and a heat transfer medium of a material flowable to substantially fill the space between said thermal element and said heat exchange surface.

12. The water station of claim 11 wherein said heat exchange surface comprises a plastic material.

13. The water station of claim 11 wherein said heat transfer medium comprises a thermal mastic material.

14. The water station of claim 11 wherein said thermal element comprises a chiller device.

15. A water station, comprising:

a station housing;

a reservoir mounted within said station housing for receiving and supporting a supply of water;

means for dispensing water from said reservoir; and temperature control means to control the temperature of water within said reservoir, said temperature control means comprising a temperature controlled thermal element, a heat exchange surface in heat transfer relation with water within said reservoir, and a heat transfer medium of a material flowable to substantially fill the space between said thermal element and said heat exchange surface.

16. The water station of claim 15 wherein said heat exchange surface comprises a plastic material.

17. The water station of claim 15 wherein said heat transfer medium comprises a thermal mastic material.

18. The water station of claim 15 wherein said thermal element comprises a chiller device.

19. A water station, comprising:

a station housing;

a mounting cap mounted on said station housing;

a water tank having an elongated hollow construction with first and second opposite ends;

means for removably mounting said water tank first end onto said mounting cap;

said mounting cap including water inflow means for supplying water into said water tank and water outflow means for dispensing water from said water tank;

a temperature control unit; and means for removably mounting said temperature control unit onto said water tank second end.

20. A water station of claim 19 wherein said temperature control unit comprises a heating plate in direct contact with water within said tank when said temperature control unit is mounted onto said tank second end.

21. The water station of claim 20 wherein said water tank is formed from a plastic material.

22. The water station of claim 19 wherein said means for removably mounting said water tank first end onto said mounting cap comprises slide-fit mounting means.

23. The water station of claim 19 wherein said means for removably mounting said temperature control unit onto said water tank second end comprises slide-fit mounting means.

24. The water station of claim 19 further including tube means for delivering water supplied to said tank via said water inflow means to a position in close proximity with said temperature control unit.

25. The water station of claim 19 further including means for draining water from said tank.

26. The water station of claim 19 further including a water reservoir mounted within said station housing for receiving and storing a supply of water, said mounting cap being positioned beneath said water reservoir for supplying water from said reservoir via said water inflow means to said water tank.

27. The water station of claim 26 wherein said water reservoir is adapted for slide-fit mounting into and lift-out removal from said station housing.

28. A water station, comprising:

a station housing;

a mounting cap mounted on said station housing;

a water tank;

means for removably mounting said water tank onto said mounting cap in a position suspended therefrom, said mounting cap including water inflow means for supplying water into said tank;

said tank defining an opening therein at a position remote from said mounting cap when said tank is mounted onto said mounting cap;

a temperature control unit;

means for mounting said temperature control unit onto said tank to close said opening therein and to control the temperature of water within said tank; and means for dispensing water from said tank.

29. The water station of claim 28 wherein said tank is removable from said mounting cap independent of removal of said temperature control unit from said tank.

* * * * *